United States Patent [19]

Fromme et al.

[11] Patent Number: 4,558,472

[45] Date of Patent: Dec. 17, 1985

[54] ADJUSTABLE WALL SLEEVE

[75] Inventors: Klaus J. Fromme, Milwaukee; Roger D. Champagne, Menomonee Falls, both of Wis.

[73] Assignee: Bradley Corporation, Menomonee Falls, Wis.

[21] Appl. No.: 664,406

[22] Filed: Oct. 24, 1984

[51] Int. Cl.[4] ..... E03D 11/00

[52] U.S. Cl. ..... 4/252 R; 4/191; 4/DIG. 15

[58] Field of Search ..... 4/252 R, DIG. 15, 191, 4/643; 52/34, 35, 106, 217; 220/3.7

[56] References Cited

U.S. PATENT DOCUMENTS

| | | | |
|---|---|---|---|
| 740,663 | 10/1903 | Krantz | 4/252 R |
| 1,611,261 | 12/1926 | Youngblood . | |
| 1,875,101 | 8/1932 | Morrell | 220/3.7 |
| 2,841,254 | 7/1958 | Millner | 52/217 |
| 3,129,437 | 4/1964 | McClenahan | 4/252 |
| 3,251,073 | 5/1966 | Rawson | 4/252 R |
| 3,323,143 | 6/1967 | Pope | 4/252 R |
| 3,620,404 | 11/1971 | Grasso | 220/3.7 |
| 3,932,899 | 1/1976 | Brady et al. | 4/252 R |
| 3,942,201 | 3/1976 | Morris et al. | 4/252 R |
| 4,128,977 | 12/1978 | Schubeis | 52/217 |
| 4,434,516 | 3/1984 | Morris et al. | 4/252 R |

*Primary Examiner*—Stephen Marcus
*Assistant Examiner*—Linda J. Sholl
*Attorney, Agent, or Firm*—Quarles & Brady

[57] ABSTRACT

An adjustable sleeve for supporting plumbing fixtures in a high security type environment wherein the sleeve is composed of telescoping type frames which are easily adjustable to the wall thickness yet can accommodate security type devices such as reinforcing bars. The adjustable wall sleeve of this invention includes at least two frame members which telescope with respect to each other with one of the sleeve members having cutout portions to accommodate security bars normally associated with a sleeve of this type. In still an additional embodiment, a third frame member can be easily secured to the two frame members to provide for additional adjustment in the wall thickness. The frame members are readily secured to each other either by screws or welding and at the same time will accommodate various types of plumbing units which can be securely attached to them yet will provide the security needed in a high security environment such as a prison.

18 Claims, 5 Drawing Figures

ADJUSTABLE WALL SLEEVE

BACKGROUND OF THE INVENTION

This invention relates to an adjustable wall sleeve for plumbing fixtures which will hold the plumbing fixture in a secure manner in a high security environment such as a prison. More particularly, this invention relates to a wall sleeve holder for plumbing fixtures that utilizes at least two telescoping members which can expand or contract to a desired wall thickness so that the sleeve does not have to be specially preformed or customized at the place of fabrication as well as to compensate for wall thickness tolerances to assure that the sleeve never extends beyond the wall.

Adjustable wall sleeves for mounting plumbing fixtures in a high security environment and of the type concerned with this invention are disclosed in U.S. Pat. Nos. 3,942,201 and 4,434,516. Both of these patents disclose top, side and bottom wall frame members which are of one piece construction. Accordingly, for these units to be fitted into a wall space of a given depth they must be custom fabricated to fit the precise dimensions of the wall opening. This is a costly procedure requiring additional fabrication time and a high inventory of frame structures. Other types of plumbing systems especially adapted for use in prisons or mental hospitals and the like are described in U.S. Pat. No. 1,611,261 wherein a particular type of prison structure is described including plumbing fixtures concealed in shafts whereas in U.S. Pat. No. 3,129,437 a plumbing installation device is disclosed for particular use in prisons or mental hospitals.

The prior art does not provide an adjustable wall sleeve for use in securing plumbing fixtures that is readily adaptable to various types of wall openings and will provide a secure environment. The prior art is either concerned with wall sleeves of one piece construction in the frame member or specialized type plumbing fixtures for various other uses.

It is an advantage of the present invention to provide an adjustable wall sleeve for supporting plumbing fixtures in a high security environment. Other advantages are a supporting device for use in a high security environment such as a prison which can be readily adapted to fit within an opening in a wall wherein the wall opening will vary in size from wall to wall. Additional advantages are a supporting wall sleeve for use in a high security environment which can be assembled and fitted at the job site; can support in a rigid manner various types of plumbing fixtures; is adapted to be of a two piece or three piece multiple construction; can be adapted to receive and fit around various security type structures such as reinforcing bars as well as stud guides for holding the plumbing fixtures.

SUMMARY OF THE INVENTION

The foregoing advantages are accomplished and the shortcomings of the prior art are overcome by the present adjustable wall sleeve for installation in various sizes of wall openings and in a high security environment wherein the sleeve in one embodiment includes two frame members having spaced apart wall members providing an opening. Security bars are fixed to the wall members and extend across the opening. The frame members have substantially the same geometric configuration and are so dimensioned so as to telescope with respect to each other. In another embodiment, a third frame member is also provided with the same geometric configuration as one of the other frame members and is also dimensioned to telescope with respect to it. Slot means are provided with respect to one of the frame members so as to permit them to pass over the security bars in the other frame members. Securing means in the form of a threaded fastener such as a screw or alternatively a weldment can be employed to hold the telescoping members in a fixed position after they are adjusted to the opening in the wall. In a preferred manner, the frame members are of a rectangular configuration and the second and third frame members are of a larger width than the first frame member which is designed to face the inside of the cell. Additional attachment means in the form of studs and support arms are easily attached to the fixed frame member in the opening. This is accomplished by providing stud guides in at least one of the frame members.

BRIEF DESCRIPTION OF THE DRAWINGS

A better understanding of the present adjustable wall sleeve will be had by reference to the drawings wherein.

DESCRIPTION OF THE PREFERRED EMBODIMENTS

Figure 1:
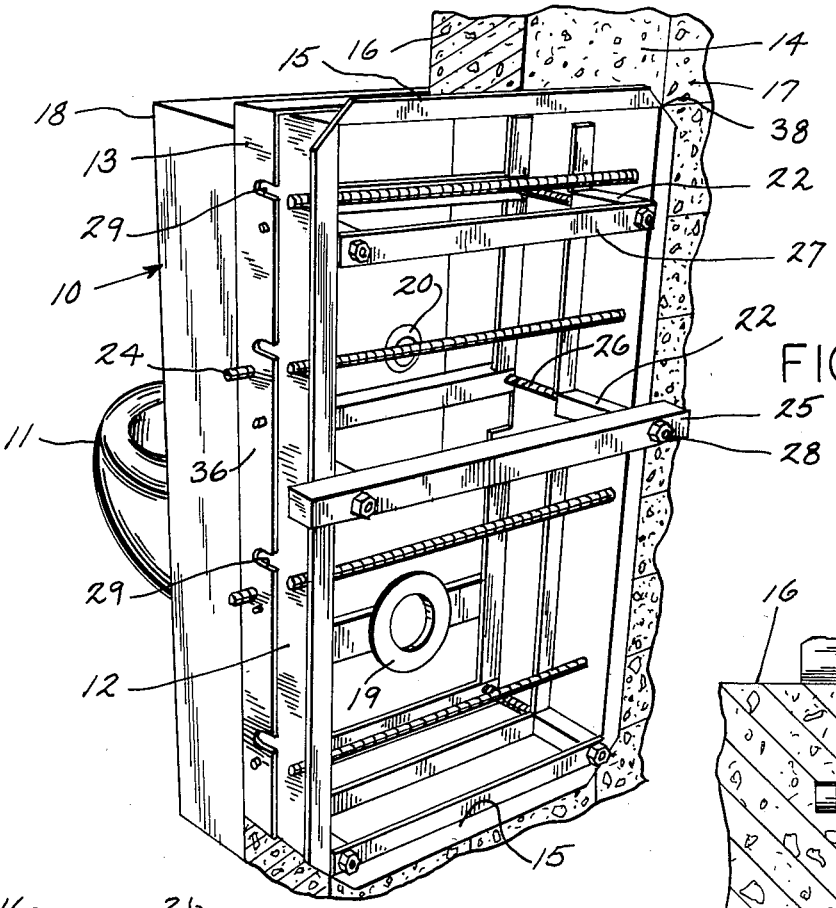
FIG. 1 is a perspective view illustrating the adjustable wall sleeve assembled in a wall and with a plumbing unit secured thereto.
Figure 2:
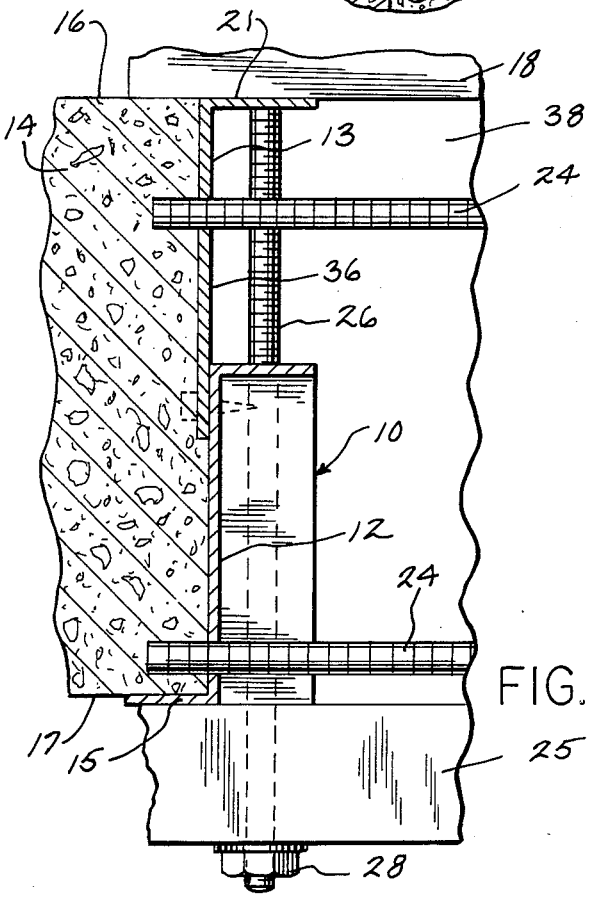
FIG. 2 is a partial view and in horizontal section illustrating the frame structure of FIG. 1 assembled in a wall.
Figure 3:
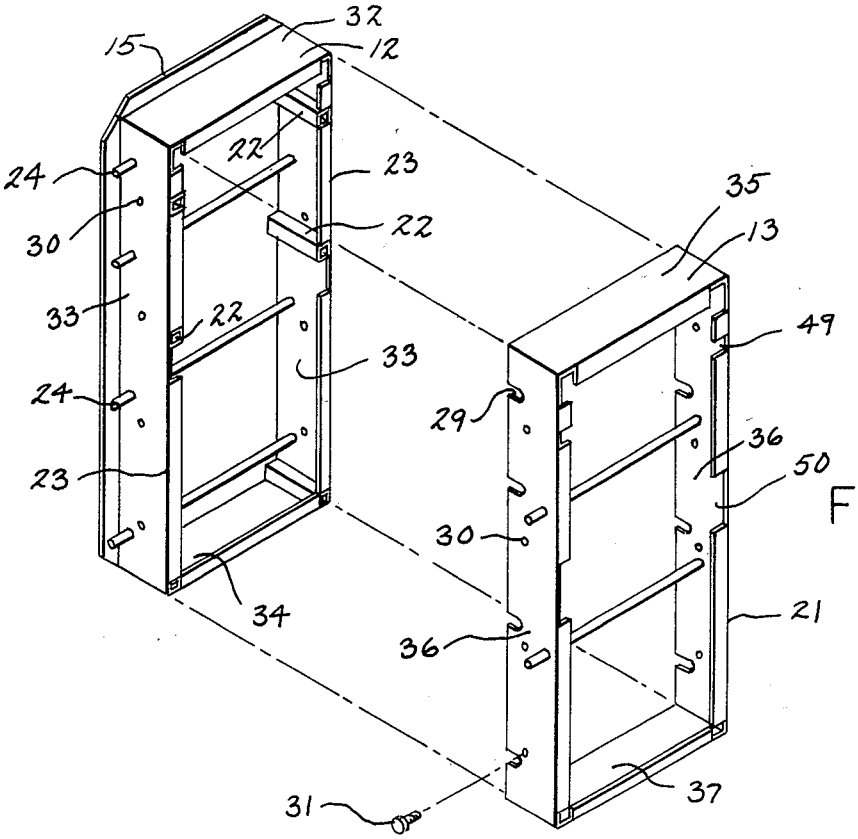
FIG. 3 is an assembly view of one of the embodiments of this invention except showing the frame members in a reversed manner as illustrated in FIGS. 1 and 2.

Proceeding to a detailed description of the invention and particularly the embodiment shown in FIGS. 1, 2 and 3, the adjustable wall sleeve generally 10 is illustrated in conjunction with a toilet 11. The adjustable wall sleeve 10 includes a first rectangular frame member 12 and a second rectangular frame member 13. These frame members are positioned inside a wall opening 38 with the flange 15 extending from the frame 12 for positioning against the outside of the cell wall or the chase side 17 of wall 14. A frame 13 is constructed so that it will telescope over the frame 12 at the outside thereof and be coplanar with the inside of the cell wall or the unit side 16 of wall 14. A plumbing unit 18 with the toilet 11 will be secured to the wall sleeve 10 in a manner to be later described in conjunction with the Operation. The unit 18 will include the usual water inlet 20 as well as a drain pipe 19. The frame member 13 includes a flange portion 21 which is placed coextensive with the wall unit side 16. The stud guides 22 are secured to the frame member 12 and are in the form of rectangular channel members which will receive the studs 26 for securing the unit 18 to the sleeve 10. To aid in this attachment, the support arms 25 and 27 will extend transversely over the stud guides 22 of the frame member 12 and be secured thereto by the nuts 28 engaging the threaded ends of the studs 26.

It will be seen that the reinforcing bars 24 are secured transversely to the frame members 12 and 13 and particularly the side walls 33. These reinforcing bars serve as a securing means to prevent prisoner escape through wall opening 38. The frame member 13 also includes four slots 29 in each of the side walls 36 and are positioned to receive those portions of the reinforcing bars 24 which extend outwardly from the side panels 33 of the frame member. It will be noted in conjunction with FIG. 3, that the openings 30 are provided in the side walls 33 and 36 and will receive the self threading fastening screws 31. It will be seen specifically in conjunction with the adjustable wall sleeve embodiment 10 as shown in FIG. 3 that the frame member 12 includes an upper top panel 32 as well as a bottom panel 34 extending between the side panel members 33. Similarly, and as shown in FIG. 3, the frame 13 has a top panel 35 and a bottom panel 37 extending between side panel members 36. It should also be pointed out that the frame member 12 also has flange members 23 opposite flange 15 for the purpose of providing rigidity.

Figure 5:
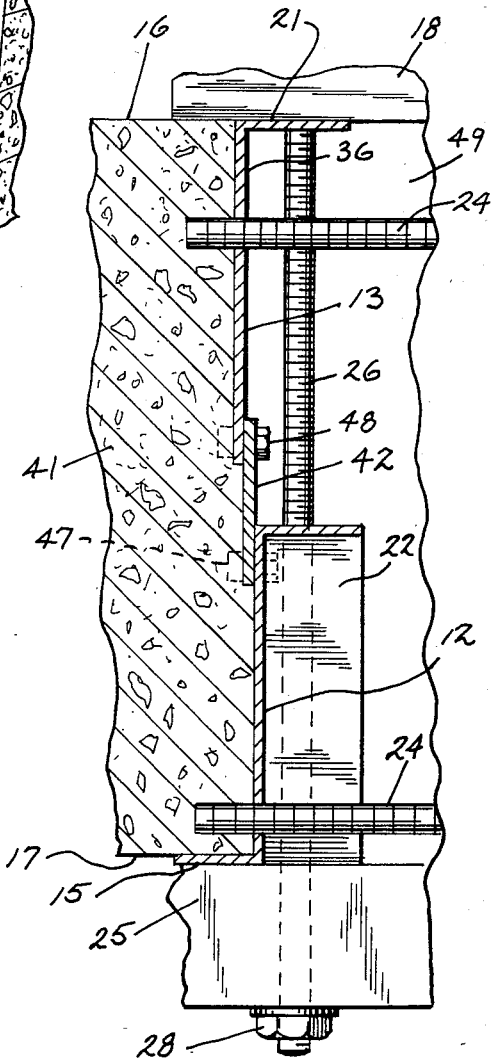
FIG. 5 is a view similar to FIG. 2 showing the embodiment of FIG. 4 assembled in a wall.
Figure 4:
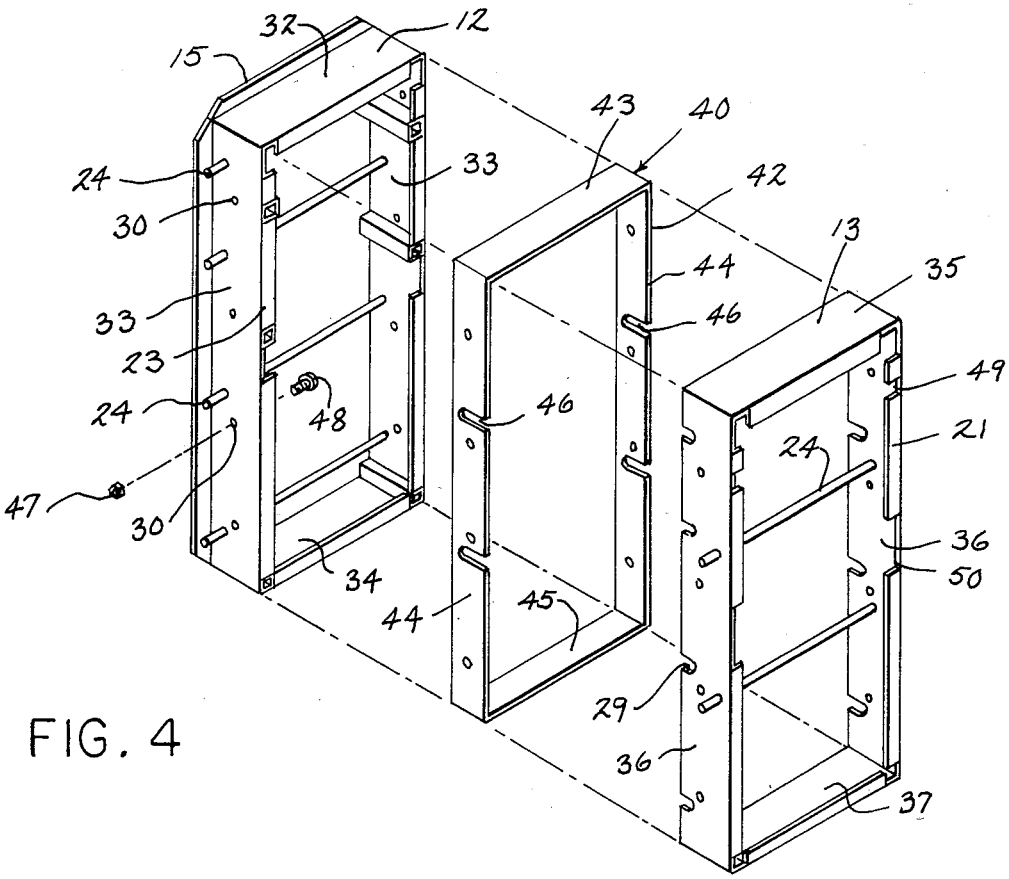
FIG. 4 is a view similar to FIG. 3 showing an alternative embodiment.

The alternative embodiment of the adjustable wall sleeve generally 40 is disclosed in FIGS. 4 and 5 and will include the frame members 12 and 13. Accordingly, the same numbers are utilized to refer to the same component parts and portions. In addition, an intermediate frame member 42 is utilized which will have a top panel 43, the side panels 44 and a bottom panel 45. The side panels will have the open slot members 46 for the purpose of receiving portions of reinforcing bars 24 extending inside the side walls 36 of the frame 13.

It will be seen in conjunction with FIG. 5 that the assembled frame structure 40 is utilized to extend in an opening 49 of the wall 41. In this instance the width of the opening 49 in the wall 41 will be of a larger dimension than the opening 38 in the wall 14.

Operation

A better understanding of the advantages of the adjustable wall sleeves 10 and 40 will be had by description of their assemblage and usage. Referring first to the embodiment 10, it will be fabricated in the two frame structures 12 and 13 as indicated in FIG. 3. When it is desired to assemble the unit in the opening 38 of the wall 14, the depth or thickness of the wall opening 38 will be measured and the frame member 13 will be fitted over frame 12 in a telescoping manner so that the depth of the combined frame members 12 and 13 is approximately equal to the depth of the opening 38. During the telescoping it will be appreciated that slots 29 will accommodate bars 24 if necessary. This telescoping will be accomplished as the cross sectional area of the frame 13 is slightly larger than that of the frame 12. The frame 12 will be positioned so that the flange 15 is adjacent and will abut against the chase side 17 of the wall 14 as best seen in FIG. 2. When this dimension is ascertained, the two frame structures will be secured together either by the use of the screws 31 fastening through the holes 30 or by the adjacent portions of the frames being welded together. The frame 13 will be positioned in a manner that the flange 21 is adjacent and coextensive with the inside or unit side 16 of the wall 14. The next step in the installation will be to have the wall 14 poured around the assembled frame structure 10 so as to secure the reinforcing bars 24 therein as best illustrated in FIG. 2. The frame structure is now ready to be assembled to the plumbing unit 18 with the toilet 11, the inlet 20 and the drain 19 which is effected by passing the studs 26 through the stud guides 22. In this instance the studs will have heads positioned on the unit 18 and on the unit side of the frame 10 and the studs will pass through the cutouts such as 49 and 50 in the frame 13. The support arms 25 and 27 will be positioned transversely over the stud guides 22 and secured thereto by the nuts 28 in the manner as seen in FIG. 1. In the assembled manner, the wall sleeve unit 10 will appear as in FIG. 2.

The assembly of the adjustable wall unit 40 will be similar to that previously described for 10 except that it will include the intermediate frame member 42. As best seen in conjunction with FIG. 5, the intermediate frame 42 will telescope over the frame 12 and the outer frame member 13 will telescope over the intermediate frame member 42. This telescoping will be aided by the slots 46 riding over bars 24 in the frame member 13, if necessary. In all other respects the assemblage and usage of the frame structure 40 is the same except that in the preferred manner will be secured together by means of the screws 48 and nuts 47 being placed through the openings 30.

The advantages of the foregoing described wall sleeves 10 and 40 will be seen in the fact that the sleeves can conform to any wall thickness from 3 $\frac{5}{8}$" up to 8" by adjusting four screws such as the 30 holding the frame members 12 and 13 together. In the preferred manner, the sleeves 10 and 40 are preassembled at the factory. At the time of installation the contractor at the job site will place the preassembled sleeves 10 and 40 in their proper location and extend the frame members such as 12 and 13 to their proper location for the wall thickness. After extending the sleeve, all the contractor has to do is to tighten the four screws 30 and the wall structure will then be poured around the secured frame members. The telescoping mounting sleeves 10 and 40 prevent fit up problems due to wall thickness variations, such as in building tolerances, or incorrect wall thickness specifications. By having the outer frame member 12 flanged as indicated at 15 and the inner frame member 13 flanged as at 21, as well as the reinforcing bars 24 in the frame members, the sleeve will be secured after the pouring of the concrete wall. The reinforcing bars 24 in the frame member 12 prevent the sleeve 10 from being worked loose from the user's side. Flanging the frame member 12 on the chase side such with the flange 15 including the bottom section prevents the total sleeve to be pulled to the user by working the concrete loose. In addition, flange 15 as well as flanges 21 and 23 add rigidity to the respective frame members.

In the frame member 12, the stud guides 22 have been indicated for use therewith. While this facilitates the placement of the studs 26 through the frame, this is not an essential component of the frame member and could be eliminated. Neither is the type of securing the various frame members 12, 13 and 42 together. The use of the screws as well as welding are merely exemplary of a type of fastening. Further, while the flanges 15 and 21 give an added security to the wall sleeves 10 and 40 of this invention, these also could be eliminated and still afford the adjustability and the high degree of security for the adjustable wall sleeves.

It will thus be seen that through the present invention there is now provided an adjustable sleeve member for a plumbing fixture that is adjustable to meet varying dimensions of openings in walls as well as variations in the wall thickness due to concrete tolerances. At the same time, the adjustable wall sleeve of this invention offers a unit having high security yet is adaptable to receiving various types of plumbing units. The adjustable securing sleeve of this invention is simple in its construction yet is highly versatile in that it can be utilized with a two or three frame structure. No special tooling is required to fasten the frame members together and the use of the adjustable wall sleeve affords a cost savings in the reduction of inventory and specialized fabrication.

The foregoing invention can now be practiced by those skilled in the art. Such skilled persons will know that the invention is not necessarily restricted to the particular embodiments presented herein but the scope of the invention is to be defined by the terms of the following claims as given meaning by the preceding description.

We claim:

1. A telescoping wall sleeve for supporting fixtures in a wall opening of a high security environment comprising:

a first frame member having spaced apart wall members defining an opening;

security bars fixed to said wall members and extending across said opening;

a second frame member having substantially the same geometric configuration as said first frame member, said second frame member constructed and arranged to telescope with respect to said first frame member;

a third frame member having substantially the same geometric configuration as said second frame member, said third frame member constructed and arranged to telescope with respect to said second frame member, two of said frame members having flange members for adjustable positioning by means of said telescoping relationship with respect to outside wall surfaces of said wall opening;

slot means operatively positioned with respect to said frame members to permit said frame members to pass over said security bars; and securing means adapted to fasten said frame members in said opening in said wall in an adjustable manner so that said flange members can be aligned with an outside wall surfaces to compensate for wall thickness and wall thickness tolerances.

2. The telescoping wall sleeve of claim 1 wherein said frame members are of a rectangular configuration.

3. The telescoping wall sleeve of claim 2 wherein said second frame member is of a smaller cross section than said first frame member.

4. The telescoping wall sleeve of claim 1 further including attachment means operatively associated with said frame members for attaching a plumbing fixture thereto.

5. The telescoping wall sleeve of claim 1 wherein said securing means to fasten said frame members in said wall opening is defined by a threaded fastening means.

6. The telescoping wall sleeve of claim 5 wherein said securing means is further defined by openings in one of said frame members.

7. The telescoping wall sleeve of claim 1 further including stud guides secured to one of said frame members.

8. The telescoping wall sleeve of claim 7 wherein said stud guides are defined by channel members.

9. The telescoping wall sleeve of claim 1 wherein said third frame member is positioned adjacent the chase side of said wall opening and has said flange member extending outwardly to contact the chase wall surface of said wall opening and said first frame member has said flange member extending inwardly therefrom and positioned adjacent the unit side of said wall opening.

10. A telescoping wall sleeve for supporting fixtures in a wall opening of a high security environment comprising:

a first frame member having spaced apart wall members defining an opening;

security bars fixed to said wall members and extending across said opening;

a second frame member having substantially the same geometric configuration as said first frame member, said second frame member constructed and arranged to telescope with respect to said first frame member, said first and second frame members having flange members for adjustable positioning by means of said telescoping relationship with respect to outside wall surfaces of said wall opening;

slot means operatively positioned with respect to said second frame member to permit said second frame member to pass over said security bars; and securing means adapted to fasten said frame members in said opening in said wall in an adjustable manner so that said flange members can be aligned with the outside wall surfaces to compensate for wall thickness and wall thickness tolerances.

11. The telescoping wall sleeve of claim 10 wherein said frame members are of a rectangular configuration.

12. The telescoping wall sleeve of claim 11 wherein said second frame member is of a smaller cross section than said first frame member.

13. The telescoping wall sleeve of claim 10 further including attachment means operatively associated with said frame members for attaching a plumbing fixture thereto.

14. The telescoping wall sleeve of claim 10 wherein said securing means to fasten said frame members in said wall opening is defined by a threaded fastening means.

15. The telescoping wall sleeve of claim 14 wherein said securing means is further defined by openings in one of same frame members.

16. The telescoping wall sleeve of claim 10 further including stud guides secured to one of said frame members.

17. The telescoping wall sleeve of claim 16 wherein said stud guides are defined by channel members.

18. The telescoping wall sleeve of claim 10 wherein said second frame member is positioned adjacent the chase side of said wall opening and has said flange member extending outwardly to contact the chase wall surface of said wall opening and said first frame member has said flange member extending inwardly therefrom and positioned adjacent the unit side of said wall opening.

* * * * *